US010626862B2

(12) United States Patent
De Talhouet et al.

(10) Patent No.: US 10,626,862 B2
(45) Date of Patent: Apr. 21, 2020

(54) DEVICE AND SYSTEM FOR MONITORING A PNEUMATICALLY ACTUATED ALTERNATING LINEAR DISPLACEMENT PUMP

(75) Inventors: Philippe De Talhouet, Paris (FR); Cédric Mosnier, Villeparisis (FR)

(73) Assignee: Exel Industries, Epernay (FR)

( * ) Notice: Subject to any disclaimer, the term of this patent is extended or adjusted under 35 U.S.C. 154(b) by 856 days.

(21) Appl. No.: 13/824,576

(22) PCT Filed: Jan. 24, 2012

(86) PCT No.: PCT/FR2012/050158

§ 371 (c)(1),
(2), (4) Date: Mar. 18, 2013

(87) PCT Pub. No.: WO2012/101379

PCT Pub. Date: Aug. 2, 2012

(65) Prior Publication Data

US 2013/0189122 A1 Jul. 25, 2013

(30) Foreign Application Priority Data

Jan. 27, 2011 (FR) ..... 11 50644

(51) Int. Cl.
*F04B 49/08* (2006.01)
*F04B 51/00* (2006.01)
(Continued)

(52) U.S. Cl.
CPC ..... *F04B 49/08* (2013.01); *B05B 9/0409* (2013.01); *F04B 9/123* (2013.01); *F04B 9/125* (2013.01);
(Continued)

(58) Field of Classification Search
CPC ..... F04B 9/125; F04B 15/02; F04B 9/127; F04B 51/00; F04B 9/123; F04B 49/08
See application file for complete search history.

(56) References Cited

U.S. PATENT DOCUMENTS 3,635,125 A 1/1972 Rosen et al.
4,405,292 A * 9/1983 Bixby, Jr. ..... F04B 9/125 137/624.14
(Continued)

FOREIGN PATENT DOCUMENTS

CN 101489685 7/2009
CN 101943151 1/2011
(Continued)

OTHER PUBLICATIONS

International Search Report, dated Jun. 6, 2012, in PCT/FR2012/050158.
(Continued)

*Primary Examiner* — Charles G Freay
*Assistant Examiner* — Lilya Pekarskaya
(74) *Attorney, Agent, or Firm* — Soquel Group LLC

(57) ABSTRACT

A device for monitoring a pneumatically-actuated alternating linear displacement pump is provided, and a system for monitoring a pneumatically-actuated alternating linear displacement pump is provided, which include elements for sensing pneumatic pressure, elements for transmitting a signal representative of the sensed pneumatic pressure, and elements for managing the pneumatically-actuated alternating linear displacement pump in accordance with the transmitted signal representative of the sensed pneumatic pressure.

10 Claims, 2 Drawing Sheets

(51) Int. Cl.

| | |
|---|---|
| ***F04B 9/127*** | (2006.01) |
| ***F04B 9/123*** | (2006.01) |
| ***F04B 9/125*** | (2006.01) |
| ***F04B 15/02*** | (2006.01) |
| ***B05B 9/04*** | (2006.01) |

(52) U.S. Cl.
CPC ..... *F04B 9/127* (2013.01); *F04B 15/02* (2013.01); *F04B 51/00* (2013.01); *F04B 2203/10* (2013.01)

(56) References Cited

U.S. PATENT DOCUMENTS 4,887,499 A 12/1989 Kipfelsberger
6,161,956 A * 12/2000 Jerkel ..... B01F 15/0203 222/134
6,205,853 B1 * 3/2001 Dei ..... G01M 3/2853 73/168
7,603,855 B2 * 10/2009 Strong ..... F15B 15/204 60/370
2008/0206066 A1 * 8/2008 Nguyen ..... F04B 9/12 417/46
2009/0283610 A1 * 11/2009 Ballu ..... B05B 7/1263 239/337
2011/0002793 A1 * 1/2011 Bauck ..... F04B 9/125 417/46

FOREIGN PATENT DOCUMENTS

| | | |
|---|---|---|
| DE | 3708989 | 10/1998 |
| EP | 2273114 | 1/2011 |
| WO | 2004/010096 | 1/2004 |
| WO | 2007/016151 | 2/2007 |
| WO | 2008/092808 | 8/2008 |
| WO | 2008/121606 | 10/2008 |

OTHER PUBLICATIONS

Chinese Office Action dated Apr. 28, 2015.
China Search Report dated Dec. 11, 2015.

* cited by examiner

DEVICE AND SYSTEM FOR MONITORING A PNEUMATICALLY ACTUATED ALTERNATING LINEAR DISPLACEMENT PUMP

BACKGROUND OF THE INVENTION

Field of the Invention

The invention relates to a device for monitoring a pneumatically actuated, reciprocating linear displacement pump.

The invention also relates to a system for monitoring a pneumatically actuated, reciprocating linear displacement pump.

Description of the Related Art

The invention is particularly useful for monitoring paint-delivery pumps in applications of pumping or of extrusion, of metering, or of regulation of liquid or thick products intended to be pumped, delivered, regulated and deposited in continuous or intermittent flow rates.

In this kind of paint-delivery pump, the reciprocating linear displacement pneumatic motor is the source of the output pressure of the product.

The ratio of the sections of the piston of the reciprocating linear displacement pneumatic motor and of the piston of the pump gives the theoretical pressure ratio between the reciprocating linear displacement pneumatic motor and the paint-delivery pump.

This theoretical pressure ratio between the reciprocating linear displacement pneumatic motor and the paint-delivery pump therefore determines the product output pressure generated by the pump.

Reciprocating linear displacement pneumatic motors operate with the pneumatic power delivered by a pressurized air supply and are usually connected to an exhaust.

The movement of reciprocating linear displacement pneumatic motors may be controlled by an electromechanical system comprising two end-of-travel contactors connected to an air directional flow valve.

This high flow rate air directional flow valve directs the pressurized air alternately into the upper chamber or the lower chamber of the motor in order to cause the piston to descend or rise, while exhausting the air expelled from the other chamber, the lower or upper chamber, of the motor.

Other techniques for controlling reciprocating linear displacement pneumatic motors, manufactured by the French company KREMLIN REXSON, have different systems of controlling the inversion of the motor: with differential motor, with inverter block, with flip-flop switch.

All these known systems for controlling the reversal of direction of reciprocating linear displacement pneumatic motors cause the piston to rise or fall by directing the pressurized air in an alternating manner in the upper chamber or the lower chamber of the motor in order to cause the piston to fall or rise, while exhausting the air expelled from the other chamber, the lower or the upper chamber, of the motor.

Monitoring devices are known for reciprocating linear displacement pneumatic motors driving pumps.

Document WO 2007/016151 A2 describes a method for controlling a pump actuated by compressed air, using a magnet mounted in the spool of the directional flow valve of the pneumatic motor and two magnetic sensors mounted in the cover of the directional flow valve in order to observe the speed and the position of the spool in this directional flow valve.

BRIEF SUMMARY OF THE INVENTION

A first object of the invention is to develop the known prior art by proposing a new device for monitoring a pneumatically actuated, reciprocating linear displacement pump, that is unaffected by magnetic interference.

A second object of the invention is to propose a new device for monitoring a pneumatically actuated, reciprocating linear displacement pump, that is economical to manufacture, easy to maintain and simple to use.

A third object of the invention is to propose a new system for monitoring a pneumatically actuated, reciprocating linear displacement pump, that is immediately understandable and simple to use.

The subject of the invention is a device for monitoring a pump for a liquid or pasty product such as a paint, said pump being a pneumatically actuated, reciprocating linear displacement pump, the pneumatic actuation being provided by a pneumatic motor, the device comprising sensor means for sensing the pneumatic pressure of the pneumatic motor, means for transmitting the signal representative of the sensed pneumatic pressure of the pneumatic motor, and means for managing the pump for liquid or pasty product, with pneumatic actuation and with reciprocating linear displacement, based on the transmitted signal representing the sensed pneumatic pressure of the pneumatic motor.

According to other alternative features of the invention:

- the pneumatic pressure sensing means comprise a single pressure sensor for measuring the pressure of a chamber of the pneumatic motor.
- the pneumatic pressure sensor may be situated outside the pneumatic motor.
- the pneumatic pressure sensor may be situated inside the pneumatic motor.

A further subject of the invention is a system of a pump for a liquid or pasty product such as a paint, said pump being a pneumatically actuated, reciprocating linear displacement pump, the pneumatic actuation being provided by a pneumatic motor, the system comprising means for sensing the pneumatic pressure of the pneumatic motor, means for transmitting the signal representative of the sensed pneumatic pressure of the pneumatic motor, and means for managing the pump for liquid or pasty product, with pneumatic actuation and with reciprocating linear displacement, based on the transmitted signal representing the sensed pneumatic pressure of the pneumatic motor.

According to other alternative features of the invention:

- the means for transmitting the signal representative of the sensed pneumatic pressure preferably transmit an electrical signal representative of the sensed pneumatic pressure to management means for managing a pneumatically actuated, reciprocating linear displacement pump.
- the means for managing a pneumatically actuated, reciprocating linear displacement pump comprise a clock or a counter capable of generating at least one timing chart representative of the change in the sensed pneumatic pressure on the basis of the transmitted signal representative of the sensed pneumatic pressure.
- the monitoring system comprising means for measuring, over several periods, the pneumatic pressure signal, and means for testing and validating this measurement only if the frequency of the signal is constant.

the monitoring system comprising means for testing and validation by learning carried out in the event of change of nozzles on the spray gun of a paint-delivery pump.

the monitoring system comprising means for recording the frequency of the pneumatic pressure signal in order to serve as a reference for filtering the periods of priming or of rising to full tone, or of working by "triggering" touches.

BRIEF DESCRIPTION OF THE DRAWINGS

The invention will be better understood by virtue of the following description given as a nonlimiting example with reference to the appended drawings in which.

DETAILED DESCRIPTION OF THE PREFERRED EMBODIMENTS

Figure 1:
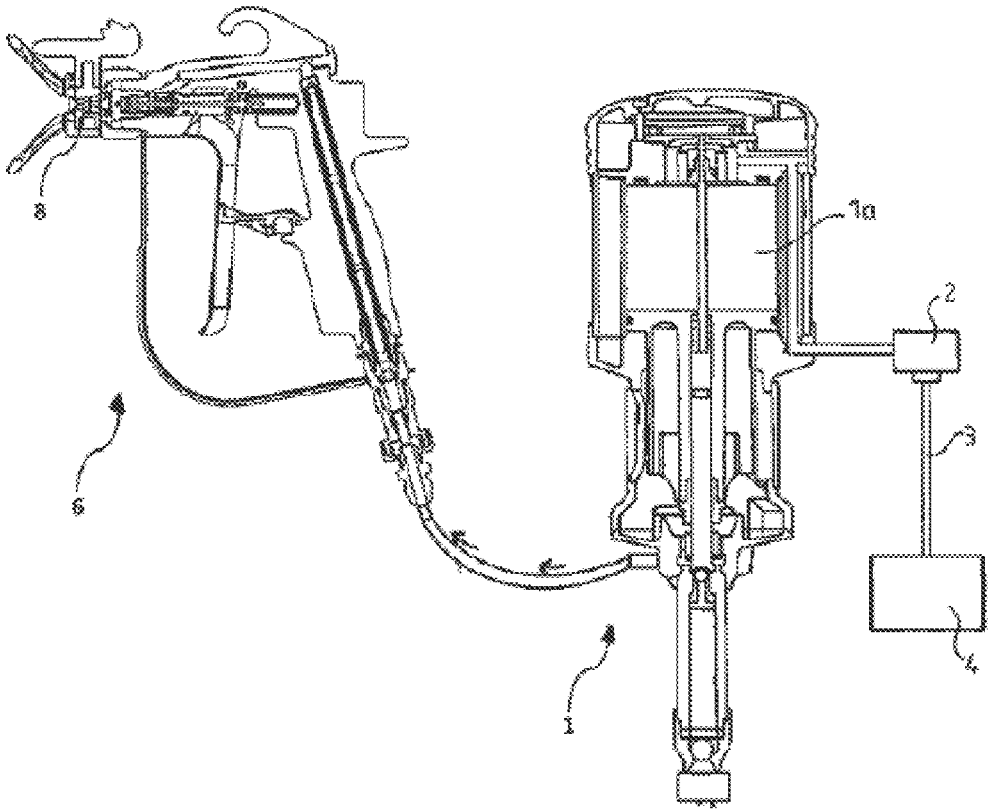
FIG. 1 represents schematically a partial view of a monitoring device according to the invention for monitoring a reciprocating linear displacement pneumatic motor driving a pump.

With reference to FIG. 1, a monitoring device for a reciprocating linear displacement pneumatic motor 1 driving a paint-delivery pump comprises sensor means 2 for sensing pneumatic pressure, transmission means 3 for transmitting the signal representative of the sensed pneumatic pressure, and means 4 for managing a pneumatically actuated, reciprocating linear displacement pump based on the transmitted signal representing the sensed pneumatic pressure.

The sensor means 2 for sensing pneumatic pressure advantageously comprise a single pressure sensor making it possible to measure the pressure of the upper chamber 1*a* of the pneumatic motor 1.

The pneumatic pressure sensor is situated outside the pneumatic motor 1 in this example.

The invention also covers the variant not shown according to which the pneumatic pressure sensor is situated inside the pneumatic motor 1.

The means 3 for transmitting the signal representative of the sensed pneumatic pressure preferably transmit an electrical signal representative of the sensed pneumatic pressure to means 4 for managing a pneumatically actuated, reciprocating linear displacement pump.

The means 4 for managing a pneumatically actuated, reciprocating linear displacement pump comprise a clock or a counter capable of generating at least one timing chart representative of the change in the sensed pneumatic pressure on the basis of the transmitted signal representative of the sensed pneumatic pressure.

The invention applies to the monitoring of all known systems for controlling the reversal of direction of reciprocating linear displacement pneumatic motors driving a delivery pump which cause the piston to rise or fall by directing the pressurized air alternately into the upper chamber or the lower chamber of the motor in order to cause the piston to fall or rise, while exhausting the air expelled from the other chamber, the lower or upper chamber, of the motor.

Figure 2:
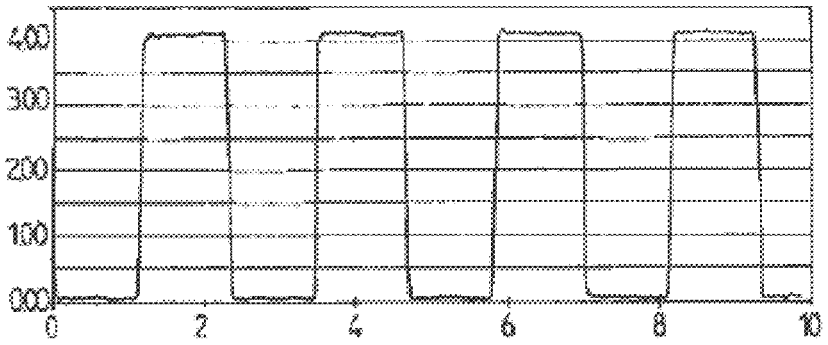
FIG. 2 represents schematically a timing chart corresponding to the monitoring of a reciprocating linear displacement pneumatic motor in normal operation by means of a system according to the invention comprising a monitoring device according to the invention.

In FIG. 2, a timing chart of the application of the system according to the monitoring system for a reciprocating linear displacement pneumatic motor 1 driving a paint-delivery pump describes a normal operation of the paint-delivery pump.

Based on the pressure measurement carried out in the chamber of the reciprocating linear displacement pneumatic motor 1, the system according to the invention for monitoring a reciprocating linear displacement pneumatic motor 1 computes the frequency of the piston of the motor 1 in order to deduce therefrom by computation the flow rate of the paint-delivery pump, and computes the value of air pressure in the motor 1 in order to deduce therefrom by computation the pressure of the paint at the output of the delivery pump.

In this kind of paint-delivery pump, the reciprocating linear displacement pneumatic motor that is the source of the output pressure of the product sustains a resistant force of the paint-delivery pump as a function of the product output pressure generated via the pump.

The regular reciprocating timing chart of FIG. 2 of the sensed pneumatic pressure P on the basis of the transmitted signal as a function of the time T therefore corresponds to a regular reciprocating cycle of the product output pressure generated by the paint-delivery pump.

Figure 3:
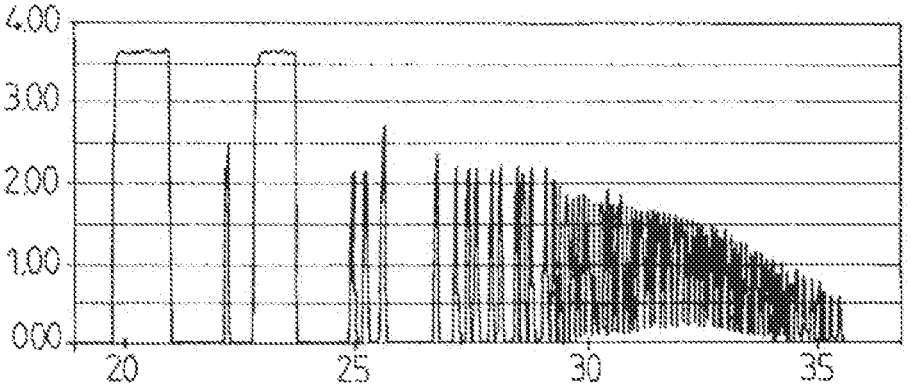
FIG. 3 represents schematically a timing chart corresponding to the monitoring of a reciprocating linear displacement pneumatic motor in faulty operation by means of a system according to the invention comprising a monitoring device according to the invention.

In FIG. 3, the timing chart of application of the system according to the invention for monitoring a reciprocating linear displacement pneumatic motor 1 driving a paint-delivery pump describes a defective operation of the paint-delivery pump.

In this kind of paint-delivery pump, the reciprocating linear displacement pneumatic motor that is the source of the product output pressure sustains a resistant force of the paint-delivery pump as a function of the product output pressure generated by the pump.

The irregular reciprocating timing chart of FIG. 3 of the sensed pneumatic pressure P based on the transmitted signal as a function of the time T corresponds to a change reflecting a substantial reduction in the cycle time of the pump, the detection of which is effective when the cycle time falls below a predetermined or computed threshold value.

This effective detection of a substantial reduction in the cycle time of the pump reflects a racing of the pump, which may for example originate from an unpriming of the pump, or of a cavitation problem.

Figure 4:
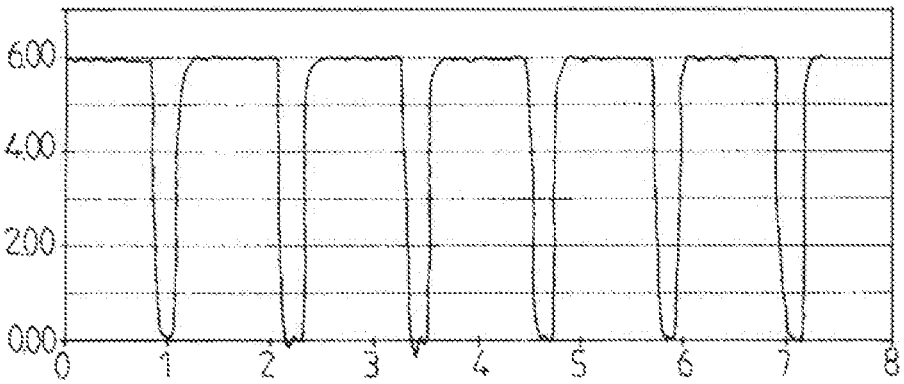
FIG. 4 represents schematically a timing chart corresponding to the monitoring of a reciprocating linear displacement pneumatic motor in faulty operation by means of a system according to the invention comprising a monitoring device according to the invention.

In FIG. 4, a timing chart of application of the system according to the invention for monitoring a reciprocating linear displacement pneumatic motor 1 driving a paint-delivery pump describes a defective operation of the paint-delivery pump.

In this kind of paint-delivery pump, the reciprocating linear displacement pneumatic motor that is the source of the product output pressure sustains a resistant force of the paint-delivery pump as a function of the product output pressure generated by the pump.

The irregular reciprocating timing chart of FIG. 4 of the sensed pneumatic pressure P on the basis of the signal transmitted as a function of the time T corresponds to a change, in which the discharge time T1 of the pneumatic pressure P is greater than the suction time T2 of the pneumatic pressure P.

This effective detection of a change, in which the discharge time T1 of the pneumatic pressure P is greater than the suction time T2 of the pneumatic pressure P originates from a leakage of the top paint-delivery valve element of the paint-delivery displacement pump.

Figure 5:
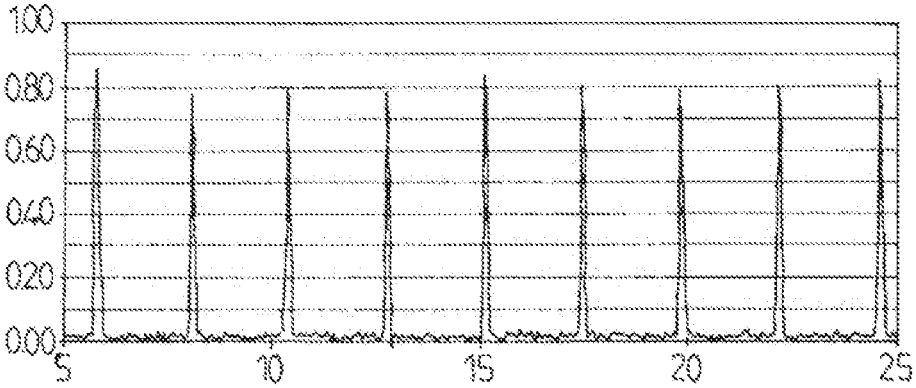
FIG. 5 represents schematically a timing chart corresponding to the monitoring of a reciprocating linear displacement pneumatic motor in faulty operation by means of a system according to the invention comprising a monitoring device according to the invention.

In FIG. 5, a timing chart for application of the system according to the invention for monitoring a reciprocating linear displacement pneumatic motor 1 driving a paint-delivery pump describes a defective operation of the paint-delivery pump.

In this kind of paint-delivery pump, the reciprocating linear displacement pneumatic motor that is the source of the product output pressure sustains a resistant force of the paint-delivery pump as a function of the product output pressure generated by the pump.

The irregular reciprocating timing chart of FIG. 5 of the sensed pneumatic pressure P based on the transmitted signal as a function of the time T corresponds to a change, in which the discharge time T1 of the pneumatic pressure P is less than the suction time T2 of the pneumatic pressure P.

This effective detection of a change, in which the discharge time T1 of the pneumatic pressure P is less than the suction time T2 of the pneumatic pressure P, originates from a leak of the paint-delivery bottom valve element of the paint-delivery displacement pump.

A first variant of a system according to the invention for monitoring a reciprocating linear displacement pneumatic motor 1 driving a paint-delivery pump advantageously comprises means for measuring, over several periods, the pneumatic pressure signal, and means for testing and validating this measurement only if the frequency of the signal is constant.

A second variant of a system according to the invention for monitoring a reciprocating linear displacement pneumatic motor 1 driving a paint-delivery pump advantageously comprises means for testing and validation by learning. In the event of change of nozzles 8 on the spray gun 6 of a paint-delivery pump, the monitoring system according to the invention repeats this learning.

The two variants of monitoring systems according to the invention for a reciprocating linear displacement pneumatic motor 1 driving a paint-delivery pump make it possible to avoid incorrect detections of leaks or errors in computing flow rate during a phase of priming or of rising to full tone, or during a normal working use by "triggering" touches.

Each system according to the invention for monitoring a reciprocating linear displacement pneumatic motor 1 therefore records the frequency of the signal which will be used as a reference for filtering the periods of priming or of rising to full tone, or of working by "triggering" touches.

By virtue of the invention, a single pneumatic pressure sensor of a chamber of a reciprocating linear displacement pneumatic motor 1 driving a paint-delivery pump makes it possible to compute the frequency of the piston of the pneumatic motor for the purpose of detecting racing, wear, or cavitation of the paint-delivery pump, to test whether the fall time of the piston is greater than the rise time for the purpose of detecting a leak of the top valve element of the paint-delivery displacement pump, to test whether the rise time of the piston is greater than the fall time for the purpose of detecting a leak of the bottom valve element of the paint-delivery displacement pump, to compute flow-rate values in different units, and to compute the output pressure of the pumped product.

The invention described with reference to particular embodiments is not limited thereto in any way, but on the contrary covers any modification of form and any variant embodiment in the context and the spirit of the invention.

The invention claimed is:

1. A monitoring device for monitoring a pump for pumping a liquid or pasty product, for malfunctions in the pump, the pump being actuated by a reciprocating linear displacement pneumatic motor having a piston and two chambers, whereby pressurized air is alternatingly directed into one of the chambers in order to raise or lower the piston, while exhausting air expelled from the other chamber, the monitoring device comprising:

a sensor sensing a pneumatic pressure over time within one of the chambers of the reciprocating linear displacement pneumatic motor;

a transmitter transmitting a signal representative of the pneumatic pressure sensed by said sensor to a managing device; and the managing device comprising a clock or counter that generates a timing chart covering at least one piston cycle based on the signal transmitted by said transmitter, the timing chart being representative of a change in the pneumatic pressure sensed by said sensor, and thus representative of a frequency of the piston, the timing chart indicating either that the pump is working in a regular periodic manner or that it is working in a non-periodic manner signifying a defect in an operation of the pump.

2. The monitoring device of claim 1, wherein said sensor comprises a single pressure sensor sensing the pressure of an upper chamber of the pneumatic motor.

3. The monitoring device of claim 2, wherein said single pressure sensor is situated outside the pneumatic motor.

4. The monitoring device of claim 2, wherein said single pressure sensor is situated inside the pneumatic motor.

5. A monitoring system monitoring malfunctions in a pump, the monitoring system comprising:

a pump that pumps a liquid or pasty product, the pump comprising:

a reciprocating linear displacement pneumatic motor actuating the pump and comprising:

a piston; and two chambers, whereby pressurized air is alternatingly directed into one of the chambers in order to raise or lower said piston, while exhausting air expelled from the other chamber; and a monitoring device, comprising:

a sensor sensing a pneumatic pressure over time within one of said chambers;

a transmitter transmitting a signal representative of the pneumatic pressure sensed by said sensor to a managing device; and the managing device comprising a clock or counter that generates a timing chart covering at least one piston cycle based on the signal transmitted by said transmitter, the timing chart being representative of a change in the pneumatic pressure sensed by said sensor, and thus representative of a frequency of said piston, the timing chart indicating either that said pump is working in a regular periodic manner or that it is working in a non-periodic manner signifying a defect in an operation of said pump.

6. The system of claim 5, wherein said two chambers comprise an upper chamber and a lower chamber, and wherein said sensor senses the pneumatic pressure over time in said upper chamber in at least two iterations, said sensor sensing in a first iteration a first pneumatic pressure signal of said pump, when said pump is operating correctly, said managing device generating a first reference validation timing chart of the first pneumatic pressure signal over time, and subsequently, in at least one second iteration said sensor sensing a second pneumatic pressure signal of said pump, said managing device testing and validating said pump by generating a second timing chart of the second pneumatic pressure signal over time, and comparing the second timing chart against the first reference validation timing chart.

7. The system of claim 6, wherein said pump comprises a spray gun with nozzles, and wherein each time a nozzle on said spray gun is changed, said sensor senses a new pneumatic pressure over time and said managing device generates a new reference validation timing chart.

8. The system of claim 6, wherein said managing device generates a timing chart of priming or of rising to full tone, or of working by triggering touches, so that when said managing device compares a subsequent timing chart of said pump to the first reference validation timing chart, said managing device filters timing variations caused by priming, or of rising to full tone, or of working by triggering touches.

9. The system of claim 6, wherein said managing device generates the first reference validation timing chart only during an operation phase of said pump during which the frequency of the first pneumatic pressure signal is constant.

10. The system of claim 5, wherein said two chambers comprise an upper chamber and a lower chamber, and wherein pressurized air is alternatively directed into said upper chamber and said lower chamber in order to raise or lower said piston.

* * * * *